US006628418B1

(12) United States Patent
Katahira

(10) Patent No.: US 6,628,418 B1
(45) Date of Patent: Sep. 30, 2003

(54) IMAGE FORMING APPARATUS HAVING A FUNCTION OF REWRITING STORED DATA INTO NEW PROGRAM DATA

(75) Inventor: Shunsuke Katahira, Hachioji (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/506,328

(22) Filed: Feb. 18, 2000

(51) Int. Cl.[7] ..... G06M 15/00
(52) U.S. Cl. ..... 358/1.16; 358/1.14
(58) Field of Search ..... 358/1.1, 1.14, 358/1.16, 1.17, 444, 404; 345/537, 538, 533; 710/8, 13, 14, 226, 62, 72, 74, 56, 54

(56) References Cited

U.S. PATENT DOCUMENTS 4,912,670 A * 3/1990 Hattori ..... 358/1.14
5,970,221 A * 10/1999 Bolash et al. ..... 358/1.14

FOREIGN PATENT DOCUMENTS

| | | |
|---|---|---|
| JP | 07-314798 | 12/1995 |
| JP | 9-284526 | 10/1997 |
| JP | 10-283128 | 10/1998 |

* cited by examiner

*Primary Examiner*—Arthur G. Evans
(74) *Attorney, Agent, or Firm*—Foley & Lardner

(57) ABSTRACT

Control-program data stored in an FROM are stored into a memory of an outside personal computer and then, program data which are input from the personal computer are written into the FROM. When the program data written into the FROM are in abnormal, the program data in the memory of the personal computer are written into in FROM.

7 Claims, 9 Drawing Sheets

IMAGE FORMING APPARATUS HAVING A FUNCTION OF REWRITING STORED DATA INTO NEW PROGRAM DATA

BACKGROUND OF THE INVENTION

In an imaging forming apparatus, i.e., a so-called electronic copier utilizing digital technology, a document glass on which an original is placed is exposed to light, image signals corresponding to the amount of light reflected from the document glass are obtained from a CCD (charge-coupled device) type line sensor, a photoconductive drum is irradiated by laser beams corresponding to the image signals obtained form the line sensor, thereby forming an electrostatic latent image on a peripheral surface of the photoconductive drum, and the electrostatic latent image is clarified by adhering a developing agent (toner) which is previously charged (negatively).

A sheet of paper is sent to the photoconductive drum in good timing to the rotation of the photoconductive drum, and the clarified image (developing agent image) on the photoconductive drum is transferred to the sheet of paper. In this manner, the sheet on which the developing agent image is transferred is sent to a fusing apparatus.

The fusing apparatus comprises a heating roller and a pressure roller. While the sheet of paper is sandwiched between both the rollers for transferring the sheet, the developing agent image on the sheet is fused by heat of the heating roller. The fused sheet is ejected to a tray.

In such an electronic copier, control program data are stored. When the program data are rewritten into new program data, a personal computer, e.g., is connected to a body of the electronic copier, and the new program data stored in the personal computer are downloaded into a memory within the body. By this download, the old program data are overwritten with the new program data.

However, when the program data in the memory is overwritten with the new program data, an abnormal condition may occur in the rewritten program data in some cases. With the program data in which the abnormal condition occurs, the electronic copier can not operate appropriately.

BRIEF SUMMARY OF THE INVENTION

The present invention has been accomplished in view of the above circumstances, and it is an object of the invention to provide a reliable and excellent imaging forming apparatus which can promptly return newly rewritten program data into old program data before rewritten when the new program data cause abnormal condition, and which can avoid unnecessary halting of the apparatus.

An imaging forming apparatus of the present invention comprises:

a first memory in which control program data are stored, a second data storing memory, an inputting section for inputting data, first control means for storing the program data in the first memory into the second memory and then, writing the program data input by the inputting section into the first memory, and second control means for writing the program data in the second memory if necessary after the program data are written by the first control means.

DETAILED DESCRIPTION OF THE INVENTION

[1]A first embodiment of the present invention will be explained below.

Figure 1:
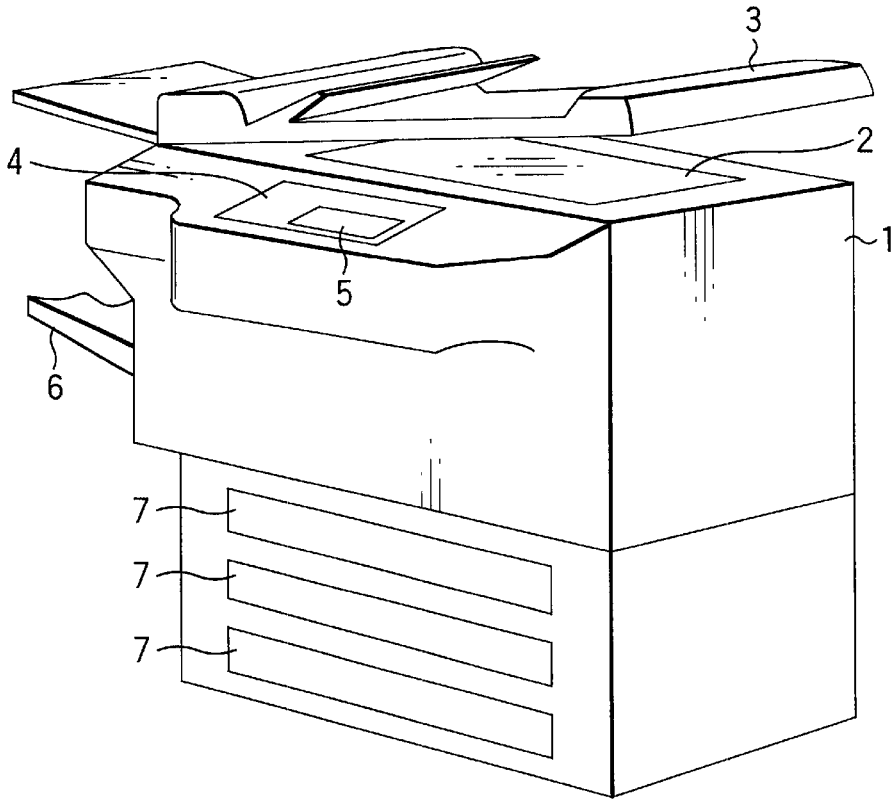
FIG. 1 is an external view of an electronic copier according to each of embodiments.

First, FIG. 1 is an external view of an imaging forming apparatus, e.g., an electronic copier.

A document glass 2 made of transparent glass is provided on an upper portion of a body 1. An automatic document feeder (ADF) 3 is provided on the document glass 3 such that the feeder can open and close. The automatic document feeder 3 automatically draws the sheets of paper set on the upper portion of the automatic document feeder one-sheet by one-sheet and sends the sheets onto the document glass 3.

On the upper portion of the body 1, a control panel 4 as an operating section is provided adjacent to the document glass 2. The control panel 4 is used for setting the copying operation, the number of sheets to be copied, scaling of copy, copy size and the like, and includes a display 5.

The body 1 is provided at its side with a tray 6 on which copied sheets are ejected to the tray 6. A plurality of sheet cassettes 7 in which copy sheets are accommodated are provided in lower portions of the body 1.

Figure 2:
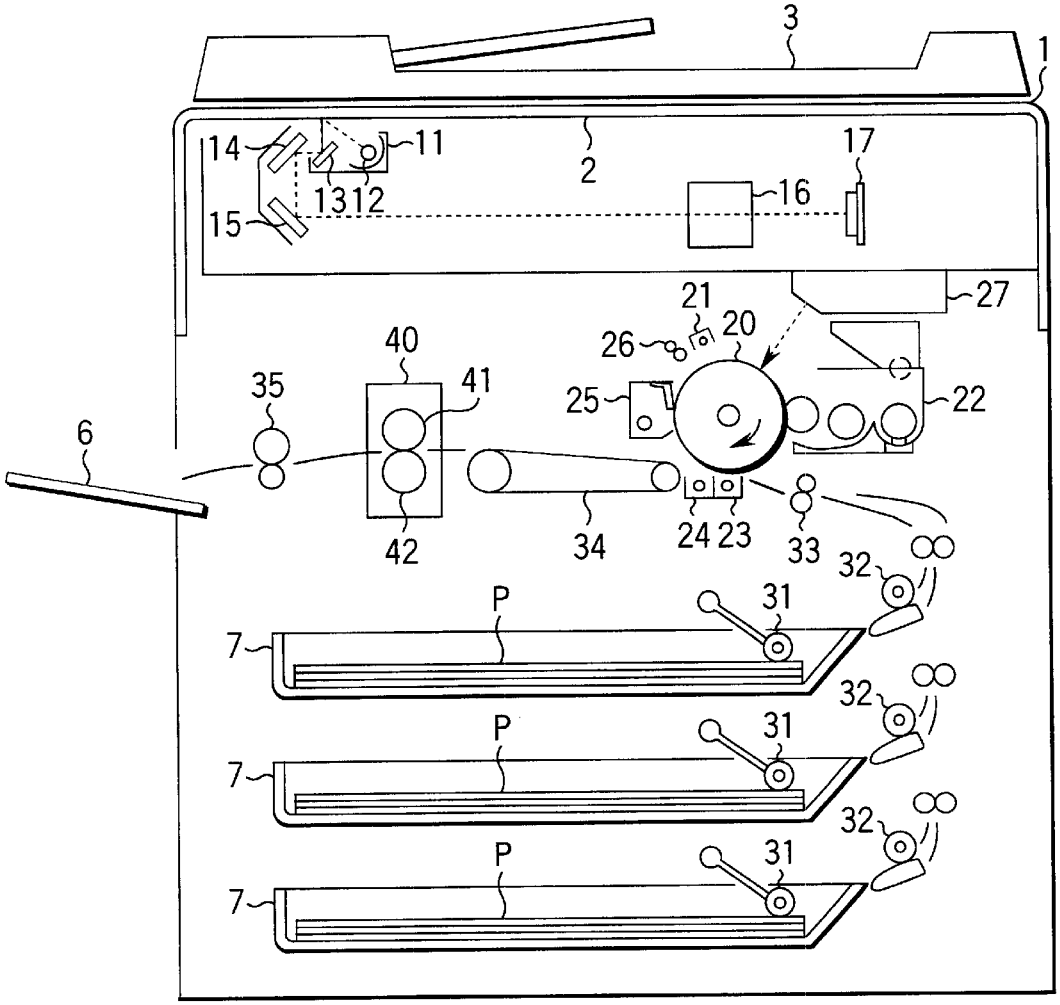
FIG. 2 is a view showing a structure of the inside of each of the embodiments.

FIG. 2 shows a structure of inside of the body 1.

A carriage 11 is provided on a back surface of the document glass 2 such that the carriage 11 can move reciprocate. The carriage 11 is provided with an light-exposure lamp 12. If the carriage 11 reciprocates while the light-exposure lamp 12 lights up, the entire surface of the document glass 2 is exposed to light and scanned.

By this exposure scan, a reflection light image of the document placed on the document glass 2 is obtained, and the reflection light image is projected on a CCD (charge-coupled device) type line sensor (CCD sensor, hereinafter) 17. The CCD sensor 17 outputs image signals of voltage level corresponding to a received light amount. The image signals are sent to a laser unit 27. The laser unit 27 emits laser light corresponding to the image signals.

A photoconductive drum 20 is rotatably provided in the vicinity of the laser unit 27. An electrified charger 21, a developing device 22, a transfer charger 23, a peeling charger 24, a cleaner 25 and a diselectrifying device 26 are disposed in sequence around the photoconductive drum 20. Laser light emitted from the laser unit 27 passes through a space between the electrified charger 21 and the developing device 22, and a peripheral surface of the photoconductive drum 20 is irradiated with the laser light.

Each of the sheet cassettes 7 is provided in a lower portion of the body 1. Many sheets of copy paper P are accommodated in each of the sheet cassettes 7. A pickup roller 31 is provided in each of the sheet cassettes 7 for drawing out the copy paper P one-sheet by one-sheet.

At the time of copying operation, the copy paper P is drawn out one-sheet by one-sheet from any one of the sheet cassettes 7. The drawn out paper P is separated from the sheet cassette 7 by a separator 32, and sent to a register roller 33 where the paper P waits the rotation of the photoconductive drum 20. The register roller 33 sends the paper P into a space between the transfer charger 23 and the photoconductive drum 20 with timing of rotation of the photoconductive drum 20.

At the time of copying operation, the photoconductive drum 20 rotates in a direction of the arrow shown in the drawing. The electrified charger 21 applies high voltage supplied from a high voltage source (not shown) to the photoconductive drum 20 so that the surface of the photoconductive drum 20 is electrostatically charged. By this charging and irradiation of laser light onto the photoconductive drum 20 from the laser unit 27, an electrostatic latent image is formed on the photoconductive drum 20.

The developing device 22 supplies developing agent to the photoconductive drum 20. The electrostatic latent image on the photoconductive drum 20 is clarified by the developing agent. The transfer charge 23 transfer the clarified image (developing agent image) on the photoconductive drum 20 to the paper P sent from the register roller 33. The paper P to which the image is transferred is peeled off from the photoconductive drum 20 by the peeling charger 24. The peeled paper P is sent to a fusing apparatus 40 by a transfer belt 34.

The fusing apparatus 40 comprises a heating roller 41 and a pressure roller 42. While the paper P is sandwiched between both the rollers for transferring the paper, the developing agent image on the paper P is fused by heat of the heating roller 41. The paper P passing through the fusing apparatus 40 is ejected into the tray 6 by a transfer roller 35.

Figure 3:
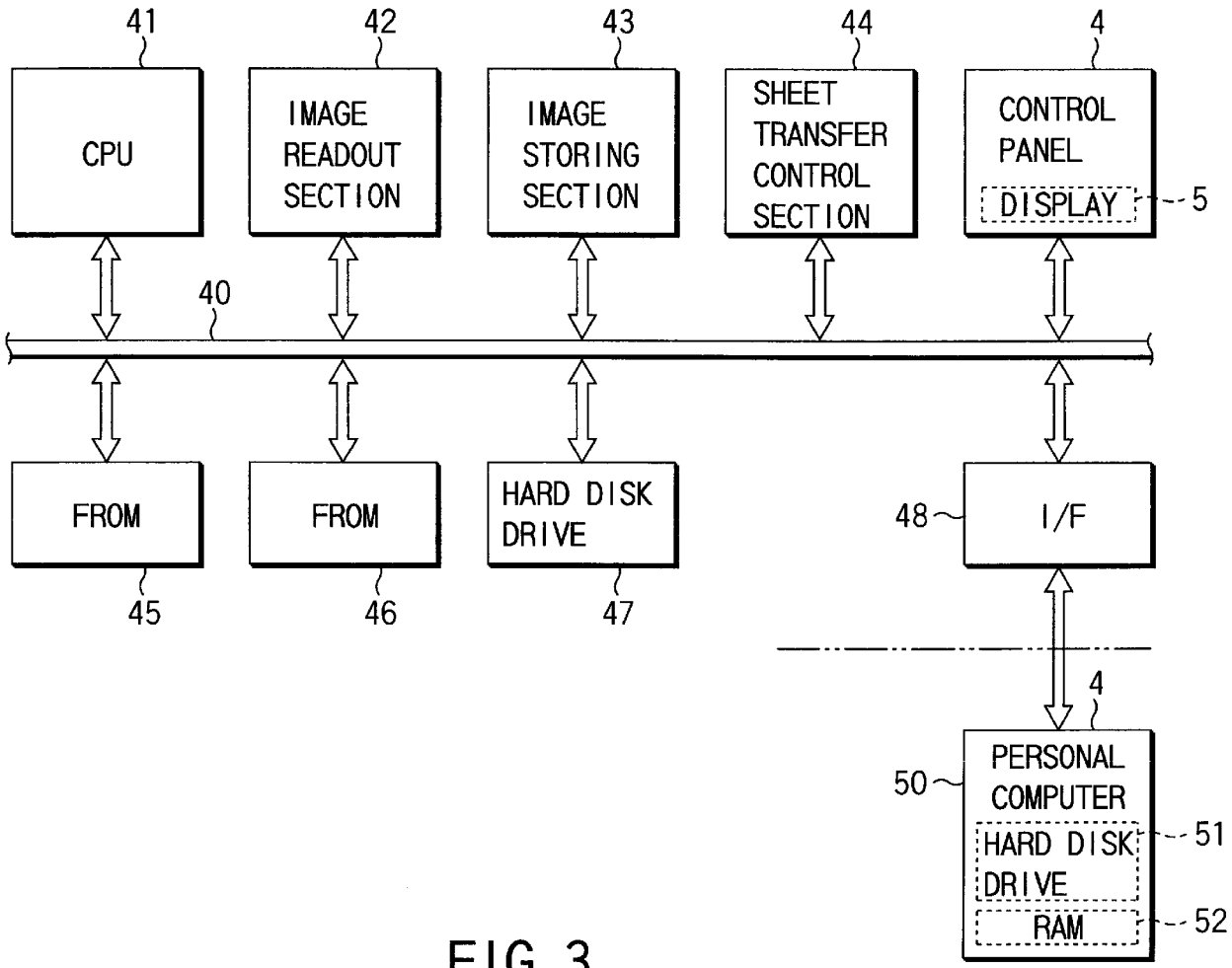
FIG. 3 is a block diagram of an electric circuit in each of the embodiments.

A control circuit mounted in such an electronic copier is shown in FIG. 3.

A CPU (central processing unit) 41 which is a control section, an image readout section 42, an image storing section 43, a sheet transfer control section 44, flash ROM (FROM, hereinafter) 45 and 46, a hard disk drive (HDD) 47, an interface 48 and the control panel 4 are connected to a data bus 40.

The image readout section 42 comprises the carriage 11, the light-exposure lamp 12, the CCD sensor 17 and the like, and optically reads an image of the document set on the document glass 2. The image storing section 43 comprises the photoconductive drum 20, the electrified charger 21, the developing device 22, the transfer charger 23, the peeling charger 24, the cleaner 25, the diselectrifying device 26, the laser unit 27 and the like, and stores the image read by the image readout section 42 onto the paper P. The sheet transfer control section 44 comprises the pickup roller 31, the separator 32, the register roller 33, other transfer roller and the like, and controls the transfer of the paper P.

The FROM 45 stores therein program data for rewriting program data in the FROM 46, and program data for diagnosing whether the program data in the FROM 46 is in abnormal.

The FROM 46 functions as a second memory, and stores program data (i.e., application program data) for various control in the electronic copier. The hard disk drive 47 stores therein image data read by the image readout section 42.

The interface 48 functions as an inputting section. When the program in the FROM 46 is rewritten, a personal computer (PC) 50 which is an external equipment is connected to the interface 48.

The personal computer 50 includes a hard disk drive (HDD) 51 and an RAM 51 as a second memory for storing program data. New program data (i.e., application program data) for rewriting the FROM 46.

The CPU 41 includes, as main functions, the following means (1) to (3).

(1) First control means: When the personal computer 50 is connected to the interface 48, and the operation for starting the rewriting of the program data is carried out on the control panel 4 by a service man, the program data in the FROM 46 are transferred to the personal computer 50 through the interface 48, the program data are stored in the RAM 52 of the personal computer 50. Then, the program data read out from the hard disk drive 51 of the personal computer 50 and input to the interface 48 are overwritten into the FROM 46.

(2) Diagnosing means: The program data in the FROM 46 after writing is carried out by the first control means are diagnosed whether there exists abnormality based on the program data in the FROM 45.

(3) Second control means: After writing is carried out by the first control means, the program data in the second memory are written onto the first memory if necessary (more specifically, when the abnormality is detected by the diagnosing means).

Figure 4:
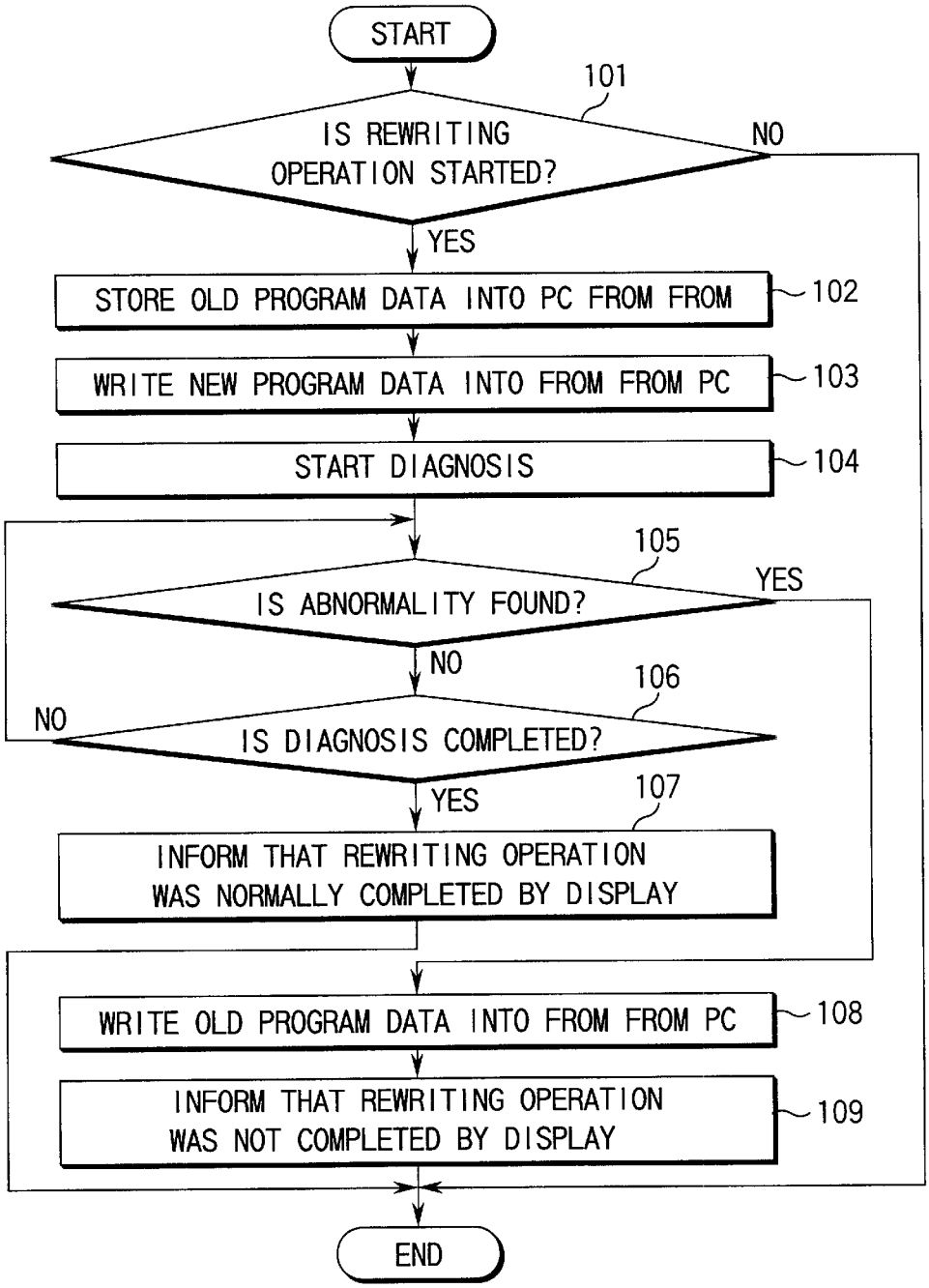
FIG. 4 is a flowchart showing control of a first embodiment.

Next, the effect of the above-described structure will be explained with reference to a flowchart shown in FIG. 4.

When the personal computer 50 is connected to the interface 48, and the operation for starting the rewriting of the program data is carried out on the control panel 4 by the service man (YES in step 101), the old program data in the FROM 46 are transferred to the personal computer 50, the program data are stored in the RAM 52 of the personal computer 50 (step 102). Then, new program data are read out from the hard disk drive 51 of the personal computer 50 and input to the interface 48. The input program data are overwritten into the FROM 46 (step 103). With this writing, the old program data stored in the FROM 46 are erased.

Then, diagnosis for detecting whether the program data in the FROM 46 is in abnormal is started (step 104). If the diagnosis is completed without detecting abnormality (NO in step 105, YES in step 106), information to the effect that the rewriting of program data is normally completed is displayed on the display 5 of the control panel 4 by means of characters for example (step 107).

If the abnormality is detected (YES in step 105), the old program data stored in the RAM 42 of the personal computer 40 are read out, and the old data are input to the interface 48. The input program data are overwritten onto the FROM 46 (step 108). By this overwriting, the new program data in the FROM 46 are erased.

At that time, information to the effect that the rewriting of program data was not completed is displayed on the display 5 of the control panel 4 by means of characters for example (step 109).

As described above, when abnormality is generated in the new program data after rewriting, since the old program data before rewriting are promptly and automatically returned to the FROM 46, it is possible to continue the appropriate operation by the program data having no abnormality without interruption. Therefore, it is possible to avoid unnecessary halting of the electronic copier, and to enhance the reliability.

[2] A second embodiment will be explained.

In the second embodiment, the diagnosis as to whether the new program data are in abnormal is relegate to operation check by the service man. Other structure is the same as that of the first embodiment.

Figure 5:
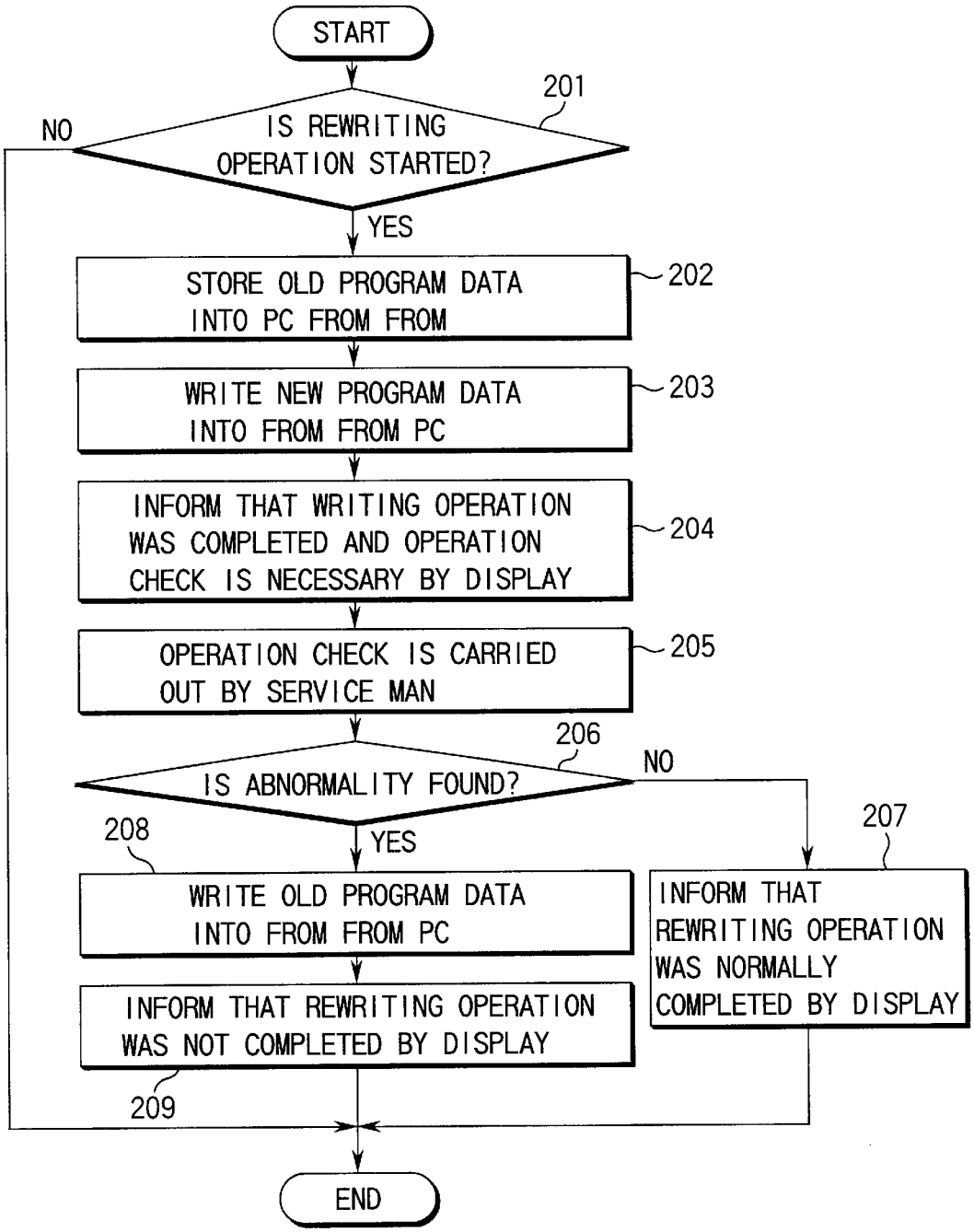
FIG. 5 is a flowchart showing control of a second embodiment.

The operation will be explained with reference to a flowchart shown in FIG. 5.

When the personal computer 50 is connected to the interface 48, and the operation for starting the rewriting of the program data is carried out on the control panel 4 by the service man (YES in step 201), the old program data in the FROM 46 are stored in the RAM 52 of the personal computer 50 (step 202). Then, new program data are read out from the hard disk drive 51 of the personal computer 50 and input to the interface 48. The input program data are overwritten into the FROM 46 (step 203). With this writing, the old program data stored in the FROM 46 are erased.

At that time, information to the effect that writing of the new program data is completed and operation check by the service man is necessary is displayed on the display 5 of the control panel 4 by means of characters for example (step 204). After this information, the operation will be checked by the service man (step 205).

Based on the information, the service man checks whether the program data in the FROM 46 are in abnormal, and he or she inputs the result of the check by operating the control panel 4.

When there is no abnormality as the result of the check which was input through the control panel 4 (NO in step 206), information to the effect that the rewriting of program data was normally completed is displayed on the display 5 of the control panel 4 by means of characters for example (step 207).

However, there is abnormality as the result of the check which was input through the control panel 4 (YES in step 206), the old program data stored in the RAM 42 of the personal computer 40 are read out, and input into the interface 48. The input program data are overwritten onto the FROM 46 (step 208). With this writing, the new program data stored in the FROM 46 are erased.

At that time, information to the effect that the rewriting of program data was not completed is displayed on the display 5 of the control panel 4 by means of characters for example (step 209).

As described above, when abnormality is generated in the new program data after rewriting, since the old program data before rewriting are promptly returned to the FROM 46, it is possible to continue the appropriate operation by the program data having no abnormality without interruption. Therefore, it is possible to avoid unnecessary halting of the electronic copier, and to enhance the reliability.

[3] A third embodiment will be explained.

In the third embodiment, the hard disk drive 47 is used as a second memory for storing the old program data. With this modification, the function of the CPU 41 is slightly different from that of the first embodiment.

Figure 6:
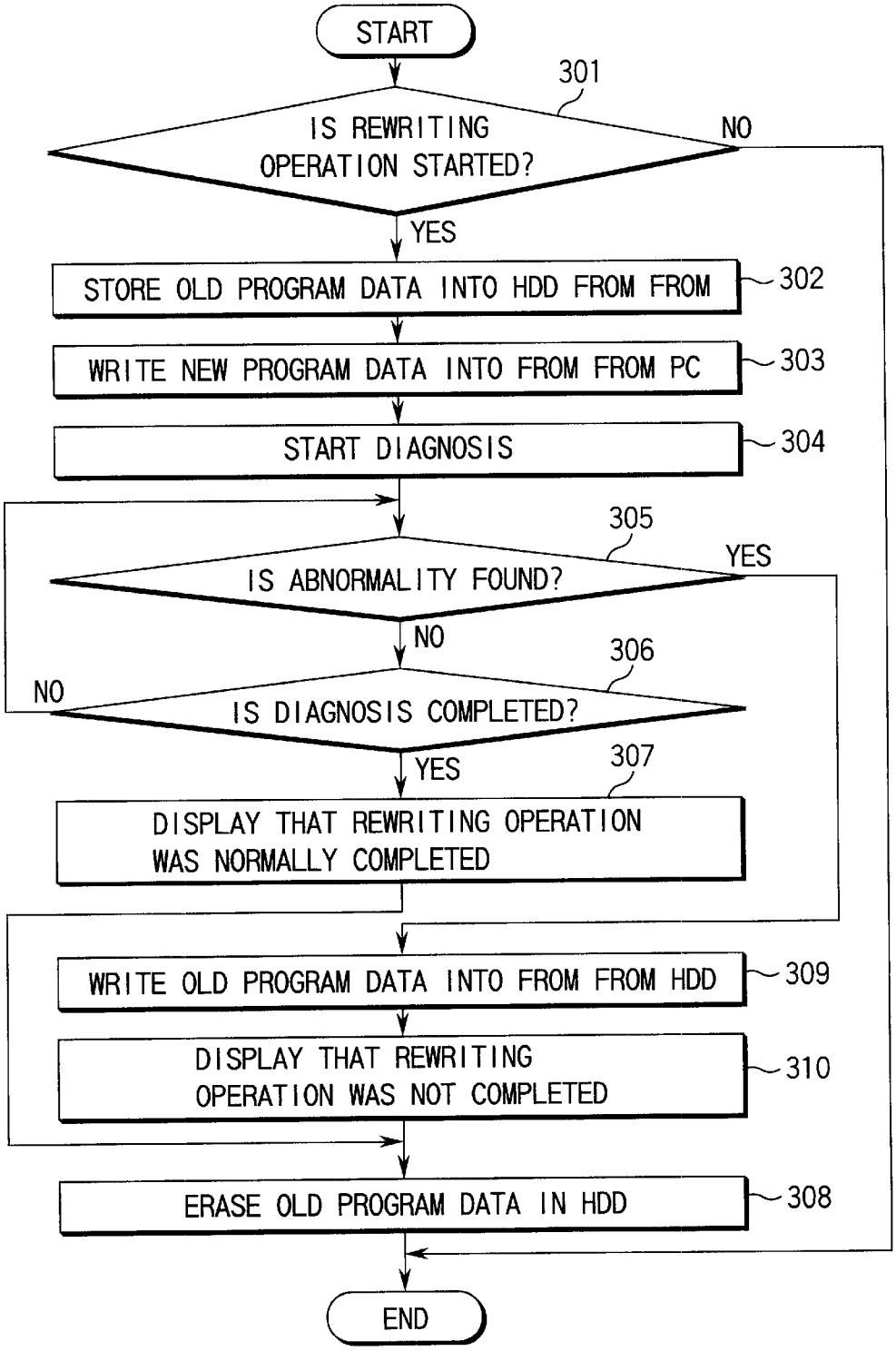
FIG. 6 is a flowchart showing control of a third embodiment.

The operation will be explained with reference to a flowchart shown in FIG. 6.

When the personal computer 50 is connected to the interface 48, and the operation for starting the rewriting of the program data is carried out on the control panel 4 by the service man (YES in step 301), the old program data in the FROM 46 are stored in a hard disk drive 51 of the personal computer 50 (step 302). Then, new program data are read out from the hard disk drive 51 of the personal computer 50 and input to the interface 48. The input program data are overwritten into the FROM 46 (step 303). With this writing, the old program data stored in the FROM 46 are erased.

Then, diagnosis for detecting whether the program data in the FROM 46 is in abnormal is started (step 304). If the diagnosis is completed without detecting abnormality (NO in step 305, YES in step 306), information to the effect that the rewriting of program data is normally completed is displayed on the display 5 of the control panel 4 by means of characters for example (step 307). At the same time, the old program data in the hard disk drive 47 are erased (step 308). With this erasing, all the storage capacity of the hard disk drive 47 is effectively utilized only for storing image data at the time of copying operation.

If the abnormality is detected (YES in step 305), the old program data stored in the hard disk drive 47 are read out, and the old data are input to the interface 48. The input program data are overwritten onto the FROM 46 (step 309). By this overwriting, the new program data in the FROM 46 are erased.

At that time, information to the effect that the rewriting of program data was not completed is displayed on the display 5 of the control panel 4 by means of characters for example (step 310). At the same time, the old program data in the hard disk drive 47 are erased (step 308). With this erasing, all the storage capacity of the hard disk drive 47 is effectively utilized only for storing image data at the time of copying operation.

As described above, when abnormality is generated in the new program data after rewriting, since the old program data before rewriting are promptly and automatically returned to the FROM 46, it is possible to continue the appropriate operation by the program data having no abnormality without interruption. Therefore, it is possible to avoid unnecessary halting of the electronic copier, and to enhance the reliability.

[4] A fourth embodiment will be explained.

Figure 7:
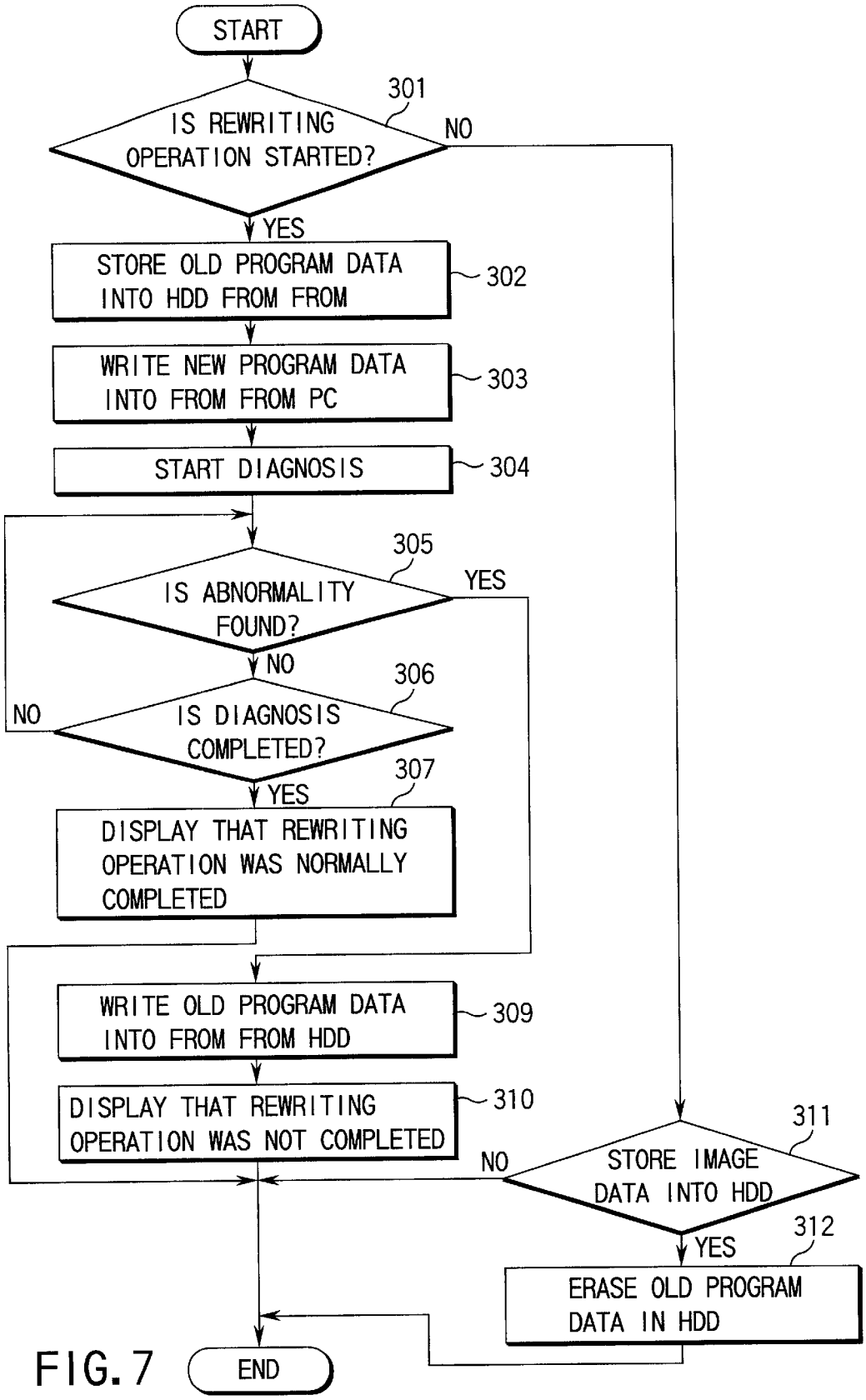
FIG. 7 is a flowchart showing control of a fourth embodiment.

In the fourth embodiment, as shown in a flowchart shown in FIG. 7, processing in steps 311 and 312 are executed instead of processing in step 308 in the third embodiment.

That is, the old program data stored in the hard disk drive 47 are erased (step 312) when the copying operation is started and it is necessary to store image data in the hard disk drive 47 (YES in step 311). With this erasing, all the storage capacity of the hard disk drive 47 is effectively utilized only for storing image data at the time of copying operation.

Other structure and effect are the same as those of the third embodiment.

[5] A fifth embodiment will be explained.

In the fifth embodiment, the diagnosis as to whether the new program data are in abnormal is relegate to operation check by the service man. Other structure is the same as that of the third embodiment.

Figure 8:
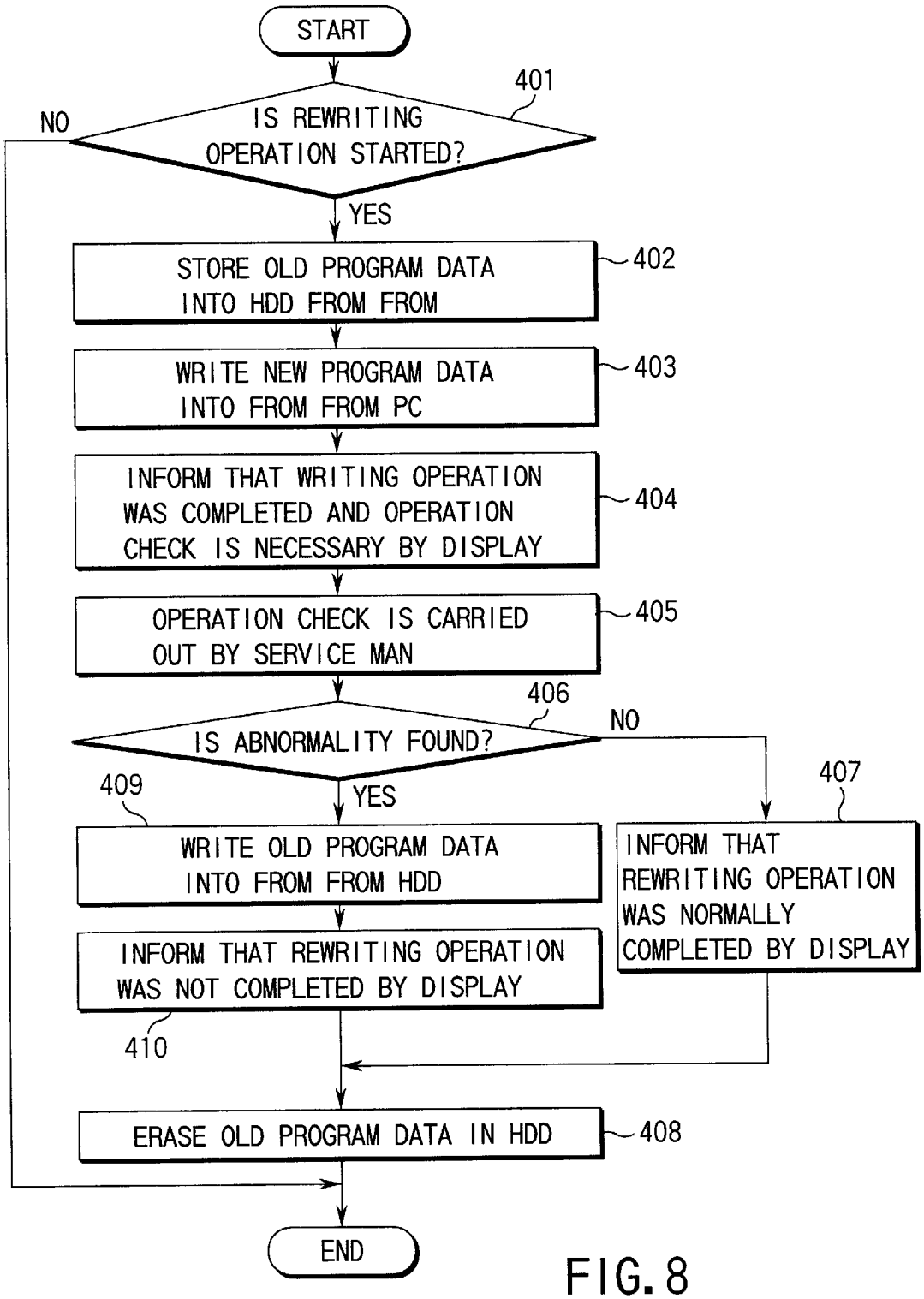
FIG. 8 is a flowchart showing control of a fifth embodiment.

That is, as shown in a flowchart shown in FIG. 8, when the personal computer 50 is connected to the interface 48, and the operation for starting the rewriting of the program data is carried out on the control panel 4 by the service man (YES in step 401), the old program data in the FROM 46 are stored in the hard disk drive 47 (step 402). Then, new program data are read out from the hard disk drive 51 of the personal computer 50 and input to the interface 48. The input program data are overwritten into the FROM 46 (step 403). With this writing, the old program data stored in the FROM 46 are erased.

At that time, information to the effect that writing of the new program data is completed and operation check by the service man is necessary is displayed on the display 5 of the control panel 4 by means of characters for example (step 404). After this information, the operation will be checked by the service man (step 405).

Based on the information, the service man checks whether the program data in the FROM 46 are in abnormal, and he or she inputs the result of the check by operating the control panel 4.

When there is no abnormality as the result of the check which was input through the control panel 4 (NO in step 406), information to the effect that the rewriting of program data was normally completed is displayed on the display 5 of the control panel 4 by means of characters for example (step 407). At the same time, the old program data in the hard disk drive 47 are erased (step 408). With this erasing, all the storage capacity of the hard disk drive 47 is effectively utilized only for storing image data at the time of copying operation.

However, there is abnormality as the result of the check which was input through the control panel 4 (YES in step 406), the old program data stored in the hard disk drive 47 are read out, and input into the interface 48. The input program data are overwritten onto the FROM 46 (step 409). With this writing, the new program data stored in the FROM 46 are erased.

At that time, information to the effect that the rewriting of program data was not completed is displayed on the display 5 of the control panel 4 by means of characters for example (step 410). At the same time, the old program data in the hard disk drive 47 are erased (step 308). With this erasing, all the storage capacity of the hard disk drive 47 is effectively utilized only for storing image data at the time of copying operation.

As described above, when abnormality is generated in the new program data after rewriting, since the old program data before rewriting are promptly returned to the FROM 46, it is possible to continue the appropriate operation by the program data having no abnormality without interruption. Therefore, it is possible to avoid unnecessary halting of the electronic copier, and to enhance the reliability.

[6] A sixth embodiment will be explained.

Figure 9:
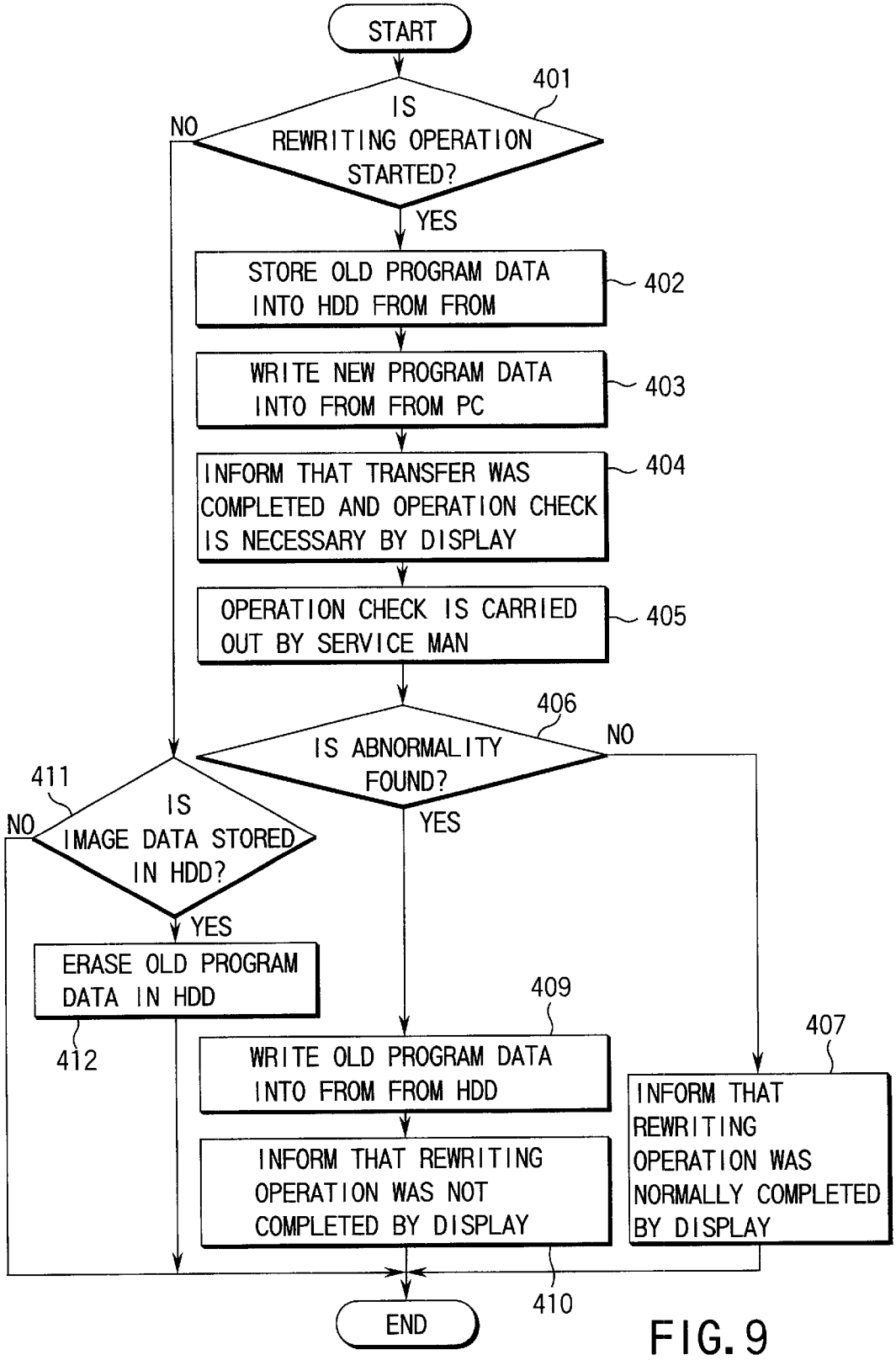
FIG. 9 is a flowchart showing control of a sixth embodiment.

In the sixth embodiment, as shown in a flowchart shown in FIG. 9, processing in steps 411 and 412 are executed instead of processing in step 408 in the fifth embodiment.

That is, the old program data stored in the hard disk drive 47 are erased (step 412) when the copying operation is started and it is necessary to store image data in the hard disk drive 47 (YES in step 411). With this erasing, all the storage capacity of the hard disk drive 47 is effectively utilized only for storing image data at the time of copying operation.

Other structure and effect are the same as those of the sixth embodiment.

What is claimed is:

1. An imaging forming apparatus comprising:

a first memory in which control program data are stored;

a second memory which stores data;

a third memory which stores program data for diagnosing whether abnormality is present in the program data stored in the first memory;

an inputting section which inputs data;

a first control section which stores the program data in the first memory into the second memory and then, writes the program data input by the inputting section into the first memory;

a diagnosing section which diagnoses whether abnormality is present in the program data stored in the first memory, based on the program data stored in the third memory, after the first control section performs a writing operation; and a second control section which writes the program data stored in the second memory into the first memory when the diagnosing section diagnoses that abnormality is present.

2. An imaging forming apparatus according to claim 1, wherein the second memory is a memory of a personal computer connected to the inputting section, or a hard disk drive in the imaging forming apparatus.

3. An imaging forming apparatus according to claim 1, wherein the second memory is for storing image data.

4. An imaging forming apparatus according to claim 3, further comprising a third control section which erases the program data in the second memory when abnormaility was not detected by the diagnosing section, and for erasing the program data in the second memory after the writing operation is executed by the second control section.

5. An imaging forming apparatus according to claim 3, further comprising third control section which erases the program data in the second memory at a time when it is necessary to store the image data in the second memory, when abnormality was not detected by the diagnosing section and after the writing operation is executed by the second control section.

6. An imaging forming apparatus according to claim 1, further comprising an informing section which informs that the rewriting operation of the program data was normally completed when abnormality was not detected by the diagnosing section, and informing that the rewriting operation of the program data was completed when abnormality was detected by the diagnosing section.

7. A control method of an imaging forming apparatus comprising the steps of: storing control program data stored in a first memory into a second memory, then writing program data which are input from outside into the first memory diagnosing whether abnormality is present in the program data written into the first memory based on diagnosis program data stored in a third memory, and writing the program data in the second memory into the first memory when abnormality is present in the program data.

* * * * *